US006561450B1

(12) United States Patent
Walsh

(10) Patent No.: US 6,561,450 B1
(45) Date of Patent: May 13, 2003

(54) FIRE HOSE WINDER

(76) Inventor: Troy E. Walsh, 122 Hollyann Dr., Folsom, CA (US) 95630

( * ) Notice: Subject to any disclaimer, the term of this patent is extended or adjusted under 35 U.S.C. 154(b) by 0 days.

(21) Appl. No.: 10/057,253

(22) Filed: Jan. 23, 2002

(51) Int. Cl.[7] ..... B65H 75/30
(52) U.S. Cl. ..... 242/395
(58) Field of Search ..... 242/395, 395.1, 242/405, 405.1, 405.2, 405.3, 406, 532.6, 546.1, 916; 137/355.16, 355.19, 355.26; 254/323; 140/149

(56) References Cited

U.S. PATENT DOCUMENTS 1,089,265 A * 3/1914 Ridley ..... 242/532.6
3,124,321 A * 3/1964 Rylott et al. ..... 242/532.6
3,168,260 A * 2/1965 Kittelson
3,946,964 A * 3/1976 Zinser ..... 242/395
4,198,010 A * 4/1980 Knapp ..... 242/532.6
4,265,414 A * 5/1981 Spradling ..... 242/532.6
4,266,740 A * 5/1981 Ramos et al. ..... 242/532.6
4,280,672 A * 7/1981 Santos et al. ..... 242/532.6
4,288,047 A * 9/1981 Barry et al. ..... 242/395
5,188,307 A * 2/1993 Miller ..... 242/406
5,205,509 A * 4/1993 Noggle ..... 242/406
5,505,404 A * 4/1996 Dubreuil ..... 242/395
5,566,901 A * 10/1996 Wilder ..... 242/395
6,206,317 B1 * 3/2001 Harvestine ..... 242/395

* cited by examiner

*Primary Examiner*—William A. Rivera
(74) *Attorney, Agent, or Firm*—Mark C. Jacobs

(57) ABSTRACT

A device for winding a flattened firefighting hose which has a T-bar of a handle and an abutted and welded shaft normally disposed to the handle. The shaft on its second end is recessed into a junction box on the opposite end of the shaft from the handle and welded into position. The junction box has a pair of preferably recessed spaced prongs emanating from the opposite face of the junction box. These prongs are also spaced apart and are of equal length. Stainless steel construction is preferred. All members are perfectly formed of round tubing though square tubing may be utilized and in either case should be preferably about ¾" in diameter.

19 Claims, 2 Drawing Sheets

FIRE HOSE WINDER

FIELD OF THE INVENTION

This invention pertains to a device to be used by one fireman to rewind a previously extended fire hose that is empty of water.

BACKGROUND OF THE INVENTION

Ofttimes one will walk or drive by a firehouse and observe a long extended fire hose, often one-hundred feet or more, being curled around itself into a spiral. A fireman or trainee is stooped over pulling and coiling the empty hose around itself such that it can thus be relocated onto a truck or stowed in the firehouse for storage. Not only is this effort tedious, but it is uncomfortable due to the continued bent over position required to carry this out. Since fire trucks often carry as much as 2,000 feet of hose in 100 to 200 foot lengths, the rewind job is not one that firefighters look forward to. Applicant, who has an employment history with several fire agencies, believed that there had to be a better way to achieve the desired result. The result is this invention.

The invention accordingly comprises the device possessing the features, properties, and the selection of components which are exemplified in the following detailed disclosure, and the scope of the application of which will be indicated in the appended claims.

For a fuller understanding of the nature and objects of the invention, reference should be made to the following detailed description, taken in conjunction with the accompanying drawings.

SUMMARY OF THE INVENTION

The device of this invention is a T-bar formed of a handle and shaft, the shaft being connected to a junction box from which emanates a pair of spaced prongs directed away from the handle of the T-bar. The structure is preferably formed of stainless steel.

Other objects of the invention will in part be obvious and will in part appear hereinafter.

DESCRIPTION OF THE PREFERRED EMBODIMENT

Figure 1:
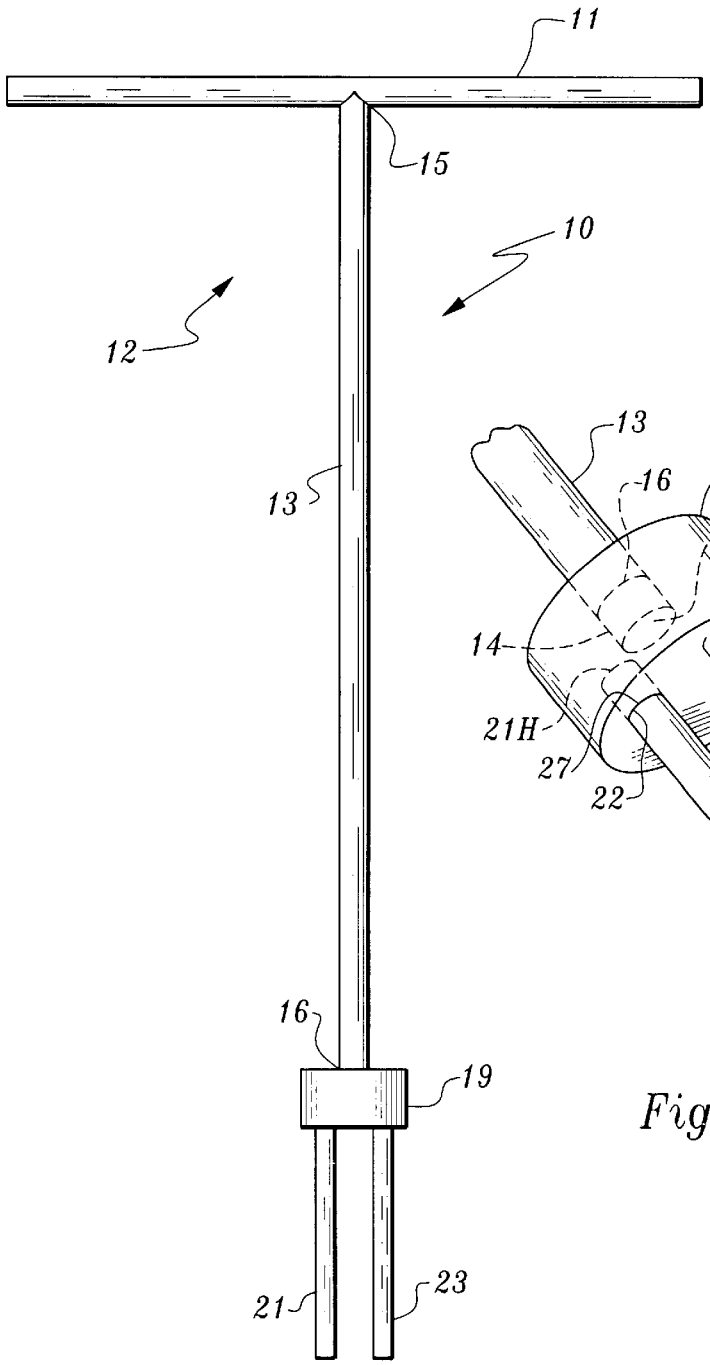
FIG. 1 is a front elevational view of the fire hose winder of this invention.

In FIG. 1 there is shown a T-bar section 12 having a handle 11 welded at its midpoint to a first end of an elongated shaft 13 at weld point 15. Handle 11 is preferably stainless steel tubing about 18" in length and ¾" in diameter. Other diameters within the range ½" 1¼" are also contemplated for use in the manufacture of the T-bar. The length could be reduced to about 15" or extended out as may be desired.

Shaft 13 of the T-bar is as noted is made of stainless steel as well. The shaft should be of the same diameter as member 11. The shaft. 13 and the handle as well, can be made within the range of ½" to 1¼" in diameter.

The second end of the shaft 13, which is the lower end not connected to the handle, is disposed preferably within abore 14 of the upper surface of junction box 19. Bore 14 should be about ½" directed inwardly. Junction box 19 is also preferably made of stainless steel and is sized to be preferably about 1½" high by about 2¾" wide. The junction box may be made bigger or smaller consistent with the diameter of the shaft and the prongs adopted. Junction box 19 is preferably cylindrical in configuration. A butt welded joining of the shaft to the junction box is also contemplated by this invention.

Figure 3:
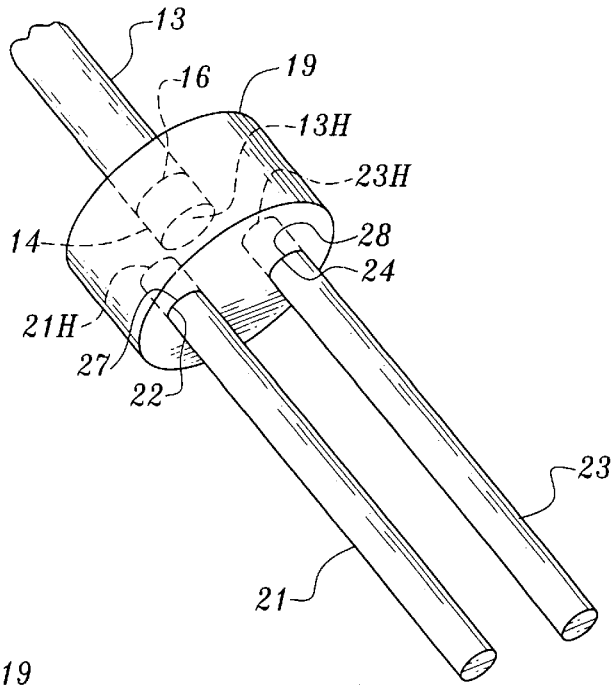
FIG. 3 is a perspective closeup view of a portion of this invention.

As seen in FIG. 3, the shaft 13 extends inwardly about ½" into the proximal, first face of junction box 19 into the bore 14. The portion disposed within bore 14 is designated 13H for the hidden portion. It is welded into a fixed position at weld point 16.

A pair of spaced prongs 21, 23 are disposed approximately ½" into the opposed distal, second surface or face of junction box 19 into bores 22 and 24 respectively. The hidden portions of these two prongs are designated 21H and 23H respectively. The two prongs are friction fit into their respective bores and welded into a fixed position as shown by weld points 27 and 28. These prongs are seen to be directed away from the handle 11 in a parallel alignment to the shaft. The spacing between the prongs may vary from about ⅜" to ⅝" in cross section, and are preferably ½" wide when used with a junction box 2¾" wide{ the direction normal to the extension of the shaft}

Figure 2:
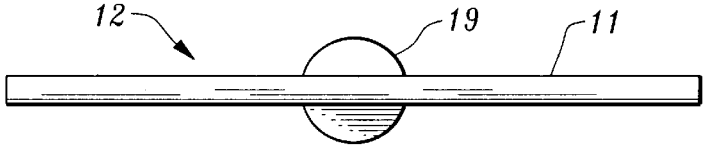
FIG. 2 is a top plan view thereof.

Reference is made to FIG. 2, the top plan view. Since the T-bar 12 preferably uses the same stock for both the handle 11 and shaft 13, the shaft 13 is not seen-in this view. Also, the junction of the shaft to the handle is butt welded to a fixed 90° position. Obviously, for the sake of balance, the shaft is disposed at the midpoint of the handle, as witness, the location of the junction box 19 in this view.

Figure 6:
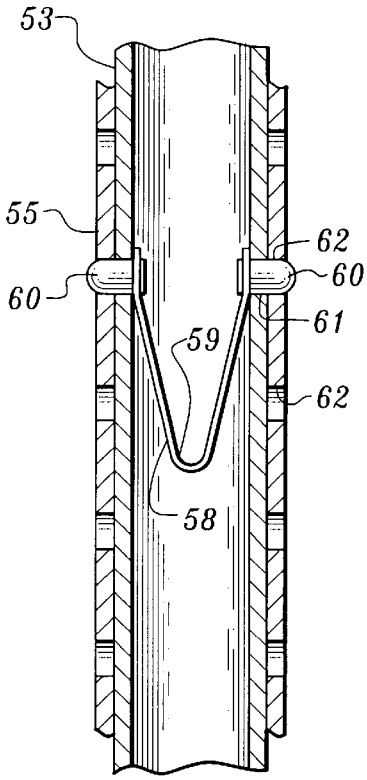
FIG. 6 is a closeup cutaway view of a feature of the variant of this invention.
Figure 5:
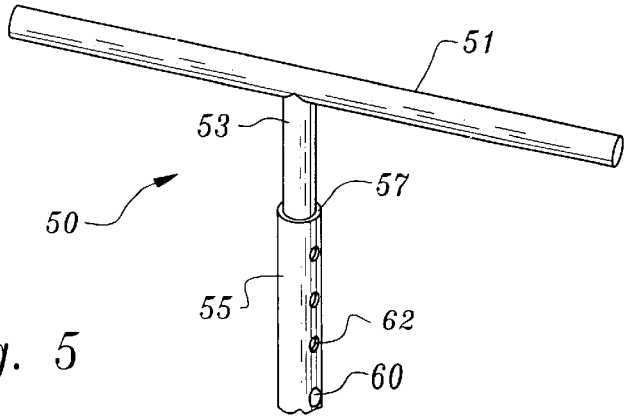
FIG. 5 is a top perspective view of the variant of this invention.

Prior to discussing the use and operation of the device, the variant aspect shown in FIGS. 5 and 6 is to be discussed. Applicant has concluded that the optimal total elevation for this device is about 36¾" inches. This is calculated based on 6" elevation for the prongs of which ½" is recessed; a height of 1½" for the junction box; a length of 30" for the shaft of which ½" is recessed and ¾" for the outside diameter of the handle. It is seen that ¾+29½+6+½, {this last being the amount of junction box not containing the top and bottom inserts} equals 36¾. This elevation is equal to the height of the belt buckle of today's average American male. By choosing this total elevation, operation is conducted by the user at a waist high location for most men. As may be desired, the amount of inches for the total elevation can be made smaller for the typical American female or males and females of other countries by changing the shaft length.

Since the device is the height set forth above, it is intended for on truck storage or on wall storage at a fire station rather than being carried as part of a backpack.

It has been found, however, that there are times when a collapsible version of this device is desired for in-field use. Thus, applicant conceived of having a unit 50 shown in FIG. 5 where the shaft is made in two parts, 53 and 55. Here, 53 the upper inner tube telescopes, that is, it nests into 55 the lower outer tube.

FIG. 6 is a closeup cutaway view which illustrates the junction of the upper tubular shaft 53 to lower tubular shaft 55. The mechanism utilized is a detented V-spring 58, seen here in FIG. 6. It has a spring steel V-shaped center section 59 attached to a pair of opposed button-like detents 60, one at each end of each arm of the V. The detents are seen to pass through a pair of aligned apertures in each of the upper and lower shafts 53, 55. The spaced aligned opposed openings in the upper shaft, are designated 61, while the two spaced aligned opposed openings in the lower shaft are designated 62.

Such telescoping mechanisms are well known and are readily available in the marketplace. They are used on such devices as tripods, extendable canes and crutches, among other items.

When the detents are pushed in, they clear out from the spaced bores of the outer tube. This permits the lower outer tube 55 to receive the inner tube which moves downwardly therein.

Preferably, the tubes 53 and 55 are such that they are approximately equal in length to thereby significantly shorten the stowed portion length of the device 50 from about 36¾" to about 18 inches. The lower outer tube of the shaft 55 can be made ¾" in cross section while the inner tube would be of a slightly smaller cross section such as ⅝.

Construction

The device 10 of this invention and its variant 50 are potentially subject to heavy handling and high wear and tear. Therefore, to prolong their useful life, applicant prefers the use of stainless steel tubing for its construction. Tubing is lighter in weight than rod stock. The T-bar, junction box, and spaced prongs are all made of stainless type-304, preferably the prongs and the junction box are made of stainless steel stainless type-304, as well for uniformity. The two prongs were recessed and then welded and not just butt welded to enable the spaced prongs to endure high torque, in the neighborhood of 292 pounds of torque from the rotation of the flattened water hose. The shaft is seen to be inserted into the junction box and Tigwelded thereto for strength and the same torque reason.

Since the handle to shaft junction is not subject to high torque, a butt welded junction is sufficient.

The question of the placement of grips on the handle was also considered but rejected. It was believed that overlaid rubber grips would wear out and perhaps do so at an uneven rate. To avoid the necessity of replacement, they were eliminated. This was deemed to be a satisfactory approach, because in cold weather firefighters would be wearing gloves and would be unaffected by the cold metal. Unless left lying in the sun for an extended period of time during warm weather, the T-bar should not get so hot that it cannot be handled by a firefighter.

Use and Operation

Figure 4:
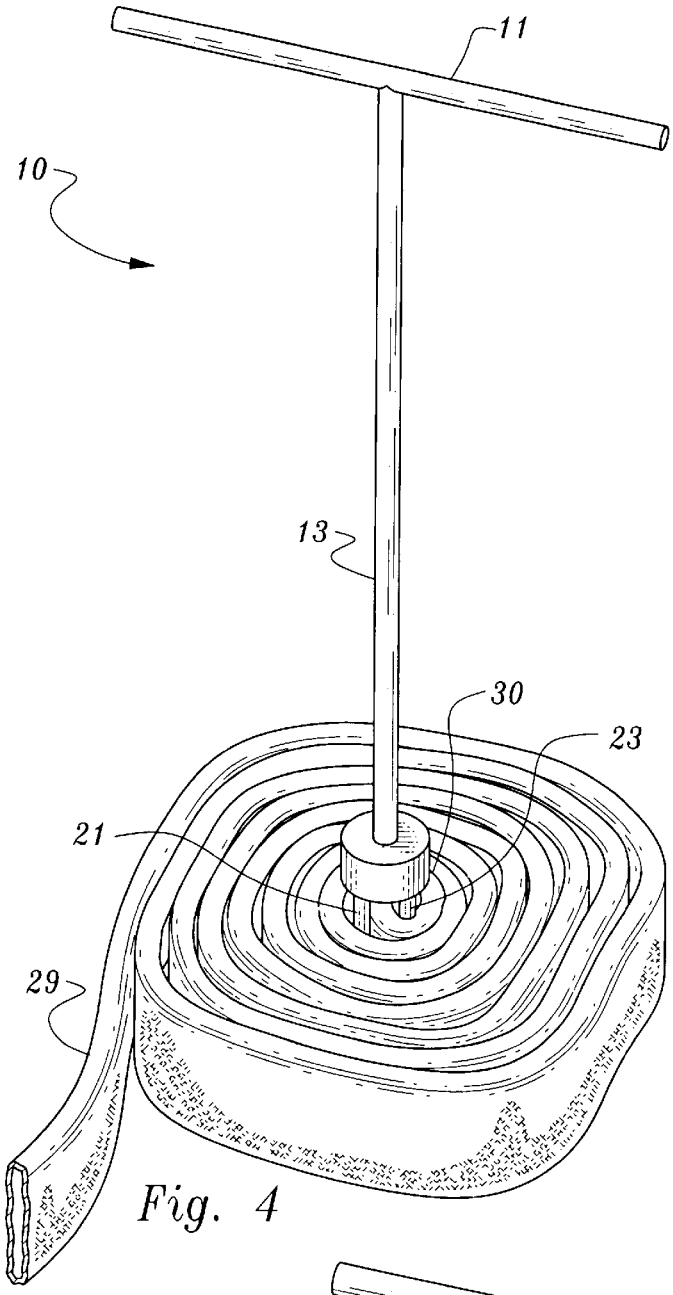
FIG. 4 is a perspective view illustrating the use of the apparatus of this invention.

Reference is now made to FIG. 4 which shows the pullout hose 29 wrapped around the device 10 (though it could just as easily be device 50 extended). Most often, the empty fire hose is folded in half along the length thereof by bringing the female connector end up toward the male connector end 30. At a point just behind (within a few inches) of the male connector end 30, the two spaced prongs are placed over the width of the hose 29, which hose has been placed in a generally vertical orientation. Unlike garden hoses, which at all times remain retain their circular cross section, empty fire hoses assume a flattened configuration due to a different construction. The operator rotates the shaft clockwise (or counterclockwise) and curls the folded over hose around itself to form a coil. The operation can be carried out in a standing position in about four minutes per 100 feet. The procedure to wind a hose not folded in half would be the same with the male connector kept at the middle of the curled hose during the course of the operation but extending out in an upward direction from the coil for easy access. In contrast, in order to wind a hose manually, the person must assume a bent over position for perhaps double the four minutes in time, or more to do the job for a 100-foot hose.

It is seen that I have created a unique, heavy-duty tool that fulfills a long existing need, namely, a tool to quickly and easily rewind fire hoses.

Since certain changes may be made in the aforementioned device without departing from the description and as shown in the accompanying drawings the discussion shall be interpreted as being illustrative of the invention and not in a limiting sense.

I claim:

1. A device for the winding of fire hoses, which device comprises a T-bar, formed of a handle and a shaft wherein the shaft's first end is disposed at the midpoint of the handle normal thereto; the second end of the shaft being connected to a first face of a junction box;

a pair of spaced prongs disposed from an opposite second face of said junction box in a direction away from said shaft and parallel thereto, each prong being spaced outwardly from said shaft.

2. The device of claim 1 wherein the shaft is formed of two telescoping and releaseable lockable members.

3. A device for the winding of fire hoses which device comprises: a T-bar formed of a handle and a shaft, wherein a first end of the shaft is welded to about the midpoint of the handle;

a junction box, generally cylindrical in shape, having a proximal face and a distal face has the shaft's second end welded to the proximal face thereof; and a pair of spaced prongs are welded to the distal face of the junction box and extend away from said shaft and parallel thereto, each prong being spaced outwardly from said shaft.

4. The device of claim 3, wherein the shaft is round and recessed into the proximal face and welded thereto.

5. The device in claim 3, wherein the spaced prongs are round and recessed up into the distal face of the junction box and welded thereto.

6. The device of claim 3 wherein the shaft is disposed about ½" into a bore in the proximal face of the junction box and the prongs are disposed up about ½" into a pair of spaced bores in the distal face of the junction box.

7. The device of claim 6, wherein the device is made entirely of stainless steel.

8. The device of claim 7 wherein the total elevation from the top of the handle the end of the prongs is about 36¾ inches.

9. The device of claim 6 wherein the T-bar is formed of ¾" diameter tubing and the prongs are ½" diameter tubing.

10. The device of claim 6 wherein the shaft is formed of two telescoping and releaseable lockable members.

11. The device of claim 10 wherein the elevation of the device when the shaft's two members are nested together is about 18 inches.

12. The device of claim 3 wherein the device is made entirely of stainless steel.

13. A device for the winding of fire hoses, which device comprises a T-bar, formed of a handle and a shaft wherein the shaft is formed of two telescoping and releaseable lockable members, of substantially equal elevation.

14. A device for the winding of fire hoses T-bar formed of an elongated handle and a round shaft, wherein the shaft is formed of two telescoping and releaseable lockable members, an outer round tube and an inner tube, and wherein a detented V-spring spring locking mechanism is disposed within the inner tube.

15. The device of claim 14 wherein the device is made entirely of stainless steel.

16. The device of claim 14 wherein the elevation of the device when the two tubes are telescoped together is about 18 inches.

17. A device for the winding of fire hoses, which device comprises a T-bar formed of a handle having an elongation of about eighteen inches and a round shaft;

wherein the shaft's first end is disposed at the midpoint of the handle normal thereto, and the second end of the shaft being connected into a first face of a junction box; and a pair of spaced round prongs disposed from an opposite second face of said junction box in a direction away from said shaft and parallel thereto.

18. The device of claim 17, wherein the shaft is formed of two telescoping round tubes that are releasably engageable.

19. The device of claim 18, wherein each prong being spaced outwardly from said shaft.

* * * * *